United States Patent [19]

Butts

[11] 4,390,197

[45] Jun. 28, 1983

[54] ELECTRICALLY CONTROLLED LATCH

[75] Inventor: Lawrence D. Butts, Charlotte, N.C.

[73] Assignee: Scovill Inc., Waterbury, Conn.

[21] Appl. No.: 306,185

[22] Filed: Sep. 28, 1981

[51] Int. Cl.[3] ..... E05B 47/00

[52] U.S. Cl. ..... 292/144; 292/169.15

[58] Field of Search ..... 292/144, 150, 245, 358, 292/169.15

[56] References Cited

U.S. PATENT DOCUMENTS 2,765,648 10/1956 Hatcher ..... 292/144 X 3,211,486 10/1965 Crandell ..... 292/358 X 3,361,462 1/1968 Foster ..... 292/245 X

*Primary Examiner*—Richard E. Moore

*Attorney, Agent, or Firm*—Dallett Hoopes

[57] ABSTRACT

A latch is provided with a rotary solenoid having an eccentrically mounted drive pin for driving a latch hub dogging means. The solenoid assembly can be easily demounted, rotated 180°, and remounted in the latch housing so that the drive pin can be made to drive the dogging blade either in or out of the latch hub dogging slot, depending on its mounted position. By this structure, the electric control may be readily converted from "fail-lock" to "fail-unlock" or vice-versa.

5 Claims, 5 Drawing Figures

ELECTRICALLY CONTROLLED LATCH

BACKGROUND OF THE INVENTION

1. Field of the Invention

This invention relates to an electrically controlled latch. More specifically, the invention relates to an electrically controlled latch which, by a simple rearrangement of parts, effects the change of the lock from one which is manually operable only when the solenoid is activated (a "fail-lock" set up) to one which is manually operable only when the solenoid is not activated (a "fail-unlock" set up), or vice versa.

The term "latch" is used herein to include either a simple latch as in the embodiment shown or any more complicated latch/lock structure.

2. Description of the Prior Art

In the prior art, there are many different showings of electrically dogged manually operable locks. Invariably, the solenoids of this type of lock have been straight-line solenoids wherein upon activation of the solenoid a dog is either retracted from or projected into engagement with the spindle hub. A change in the operation of such locks from "fail-lock" operation to "fail-unlock" operation, or from "fail-unlock" operation to "fail-lock" operation has required changing the entire solenoid assembly and wiring in the new assembly.

SUMMARY OF THE INVENTION

Under the present invention, an extremely simple structure is presented by which shifting from "fail-lock" to "fail-unlock" operation, or vice versa, is readily achievable by a simple remounting of parts within the latch housing, no wiring or new parts being necessary. More specifically, the latch of the present invention utilizes an electric solenoid having a rotary drive. The rotary drive is formed with a drive pin spaced from the center of the rotary drive plate, and the pin fits into an end of a slot in a dogging slide. The slide terminates in a dog adapted to fit into a dogging slot in the spindle hub of the latch.

In activation of the solenoid, the rotary plate rotates 20° or so from a first position to a second position causing a reciprocal movement of the slide. Spring means bias the pin in the first position. To change the lock of the present invention from "fail-lock" to "fail-unlock" or vice-versa, it is merely necessary to reverse the solenoid assembly 180° (that is, demount it, rotate it, and remount it in the latch housing) so that the pin operates in the opposite end of the slot on the slide. As a consequence, when the solenoid is activated, the drive plate rotates 20° causing the slide to drive into the spindle hub to block operation.

BRIEF DESCRIPTION OF THE DRAWINGS

Further features and objects of the invention will be apparent from reference to the following specification, including drawings, all of which disclose a non-limiting embodiment of the invention. In the drawings.

DESCRIPTION OF THE PREFERRED EMBODIMENT

Figure 1:
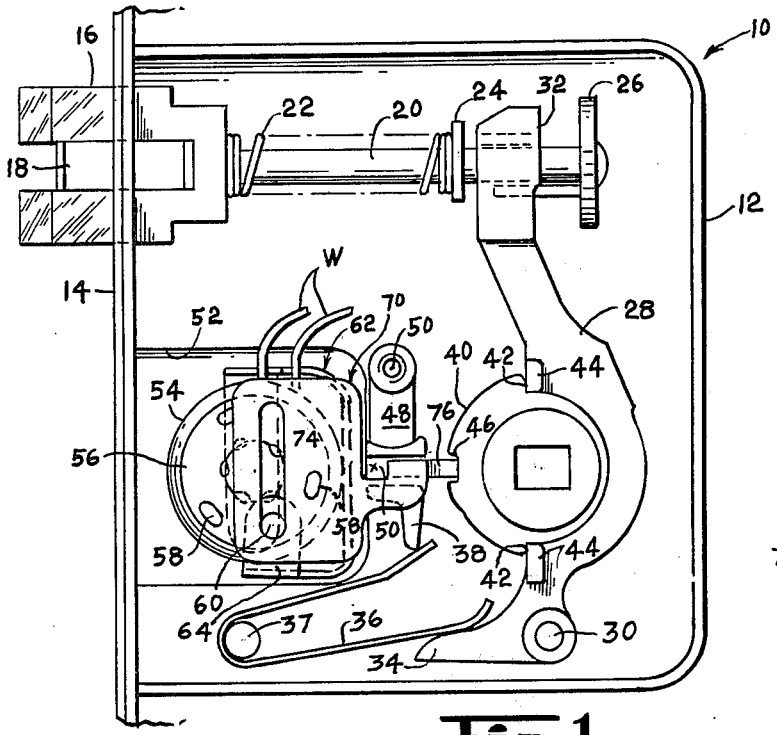
FIG. 1 is a side elevation of a latch embodying the invention and having its housing cover removed. In this drawing, the lock is shown in "fail-lock" disposition.

A latch embodying the invention is shown in FIG. 1 and generally designated 10. It comprises a housing 12 having an armored face plate 14 secured to the front thereof by means not shown. A latch bolt 16 having a conventional central plastic anti-friction lever 18 operates through an opening in the face plate 14, as is conventional.

From the latch bolt, an operating rod 20 extends inward and is spring-biased by spring 22 disposed between the rear end of the latch bolt and a journal 24. The rod terminates rearwardly in an operating flange 26.

A tailpiece 28 is pivoted to the case by pin 30 and its upper end is bifurcated to receive rod 20. The rear surface of the bifurcation presents a bearing 32 adapted to work against the operating flange 26. As shown, the tailpiece 28 has a foot 34 biased downwardly by the leaf spring 36. Spring 36 loops about pin 37 and its opposite end is held fixed against a projection 38 cast into the housing.

Journaled in the housing in the conventional manner is the spindle hub 40 which is formed with work surfaces 42 adapted when the spindle is rotated, as by a knob or lever not shown, to work against the flanges 44 of the tailpiece. Thus, by turning the knob, the latch 16 is retracted as is conventional.

The hub 40, it will be noted, is formed with a radial recess 46. A second projection 48 is formed in the housing and is drilled and tapped as at 50 to provide attaching means for a cover-retaining bolt. Projections 38 and 48 leave between them a guideway 50 for reasons which will be explained.

The wall of the housing is formed with a substantially square recess 52 in which is disposed a rotary solenoid 54. This solenoid may be of a type as described in U.S. Pat. No. 2,887,889 which issued on May 26, 1959 to Wilbert Parisoe. Such rotary solenoids are currently available from Ledex Inc. of Vandalia, Ohio. These solenoids include a housing enclosing a coil about a central bore and an armature disposed in the bore connected fixedly to a circular drive plate having spaced inclined surfaces in which ball bearings are disposed. Thus, when the solenoid is activated, the shaft or armature and plate are pulled toward the housing resulting in a rotary motion as the ball bearings roll against the inclines.

Figure 5:
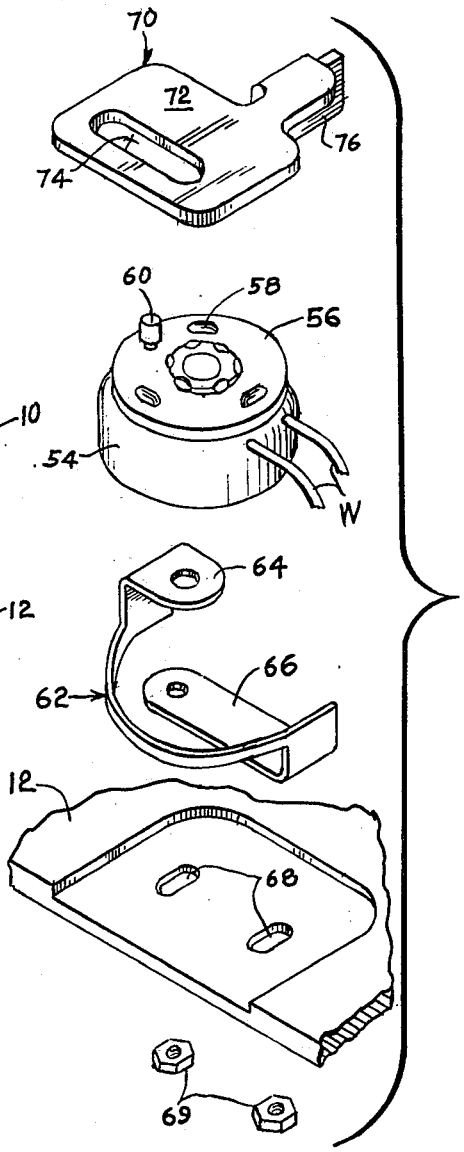
FIG. 5 is an exploded view showing in perspective various parts of a latch embodying the invention.

Referring again to the drawings of the present case, the solenoid shown is provided with a circular drive plate 56 having spaced inclines 58 and a drive pin 60. Activation of this solenoid as explained causes the plate 56 and pin 60 to rotate clockwise approximately 20° from a first position to a second position. Biasing the drive plate and pin in the first position is a spring 62 generally of "C" shape and having an apertured ear 64 encircling pin 60 adjacent the plate 56. The opposite end of the spring 62 is formed with a mounting plate 66 (FIG. 5) which also is apertured and receives solenoid mounting bolts which are also received through slotted apertures 68 in the housing and secured by nuts 69 on the far side.

Completing the assembly is the slide 70 which comprises a substantially rectangular flat portion 72 which is formed with a straight elongate slot 74 receiving at one end the drive pin 60 (FIG. 1). Towards the hub 40, the slide is formed with a dogging blade 76 which extends approximately perpendicular to the rectangular portion 72 of the slide. The sides of the blade fit loosely in the guideway 50.

In operation, as shown in FIG. 1, when the solenoid is activated, the drive pin 60 shifts clockwise approximately 20° causing a retraction of the slide and blade 76 from the dogging slot 46 permitting the hub 40 to turn freely. As is conventional, turning of the knob associated with the hub 40 causes the surfaces 42 to act against the flanges 44 to move the tailpiece 28 and its bearing surface 32 rightwardly, retracting the latch. When the solenoid is subsequently de-activated, the spring 62 causes the pin 60 to return to the position shown wherein the blade 76 is disposed in the recess 46 of the hub blocking rotation of the knob. At this point, the spring 36 has returned the tailpiece to the position shown and the latch is extended, locking the door.

Figure 2:
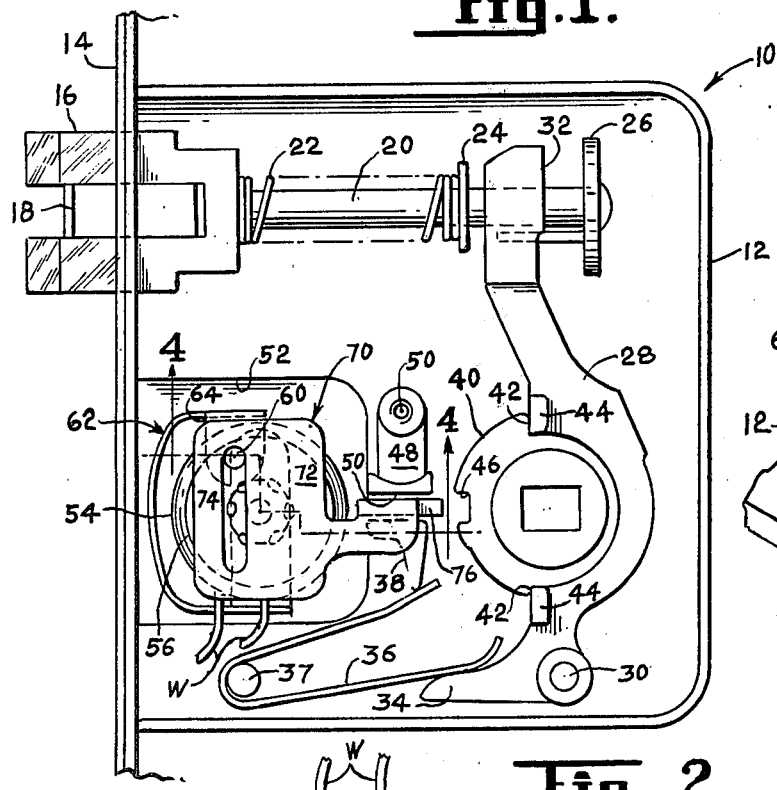
FIG. 2 is similar to FIG. 1 except that it shows the lock in "fail-unlock" disposition.
Figure 3:
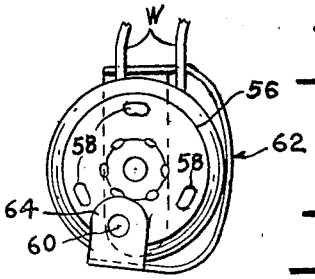
FIG. 3 is a side view of the solenoid, drive pin and spring assembly.
Figure 4:
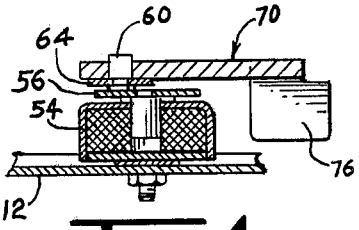
FIG. 4 is a sectional view taken on the line 4—4 of FIG. 2.

Referring now to FIG. 2, it will be seen that the operation has been modified. This is accomplished by removing the housing cover, raising the slide 70 and unbolting the solenoid housing (nuts 69) and rotating it 180° and remounting it so that the apertured ear 64 and the pin 60 are now at the top of the solenoid. Subsequently, the slide is replaced with the pin 60 in the upper portion of the slot 74. The spring 62 holds the drive plate 56 with the pin 60 in the first position shown in FIG. 2 with the result that the blade 76 clears the dogging slot 46. This permits the free operation of the latch as the lever or knob (not shown) is turned. Upon activation of the solenoid 54, as shown in FIG. 2, the drive plate 56 is rotated 20° or so clockwise causing the pin 60 in slot 74 to drive the blade 76 into the slot 46, blocking the hub and knob or lever from operating the latch.

Wires W are partly shown, but their full extent and wiring to appropriate switch means will be understood by those skilled in the art.

It will be apparent to those skilled in the art that an essential benefit of the present invention is the ability of the cycle of operation of the lock to be reversed without re-wiring or the replacement or addition of parts. As explained, it is reversed by simply reversing 180° the disposition of the solenoid 54–56. Thereby, the latch may be changed from "fail-lock" to "fail-unlock" as is desired by the owner or operator.

It will also be apparent to one skilled in the art that while the invention has been shown in a single embodiment, it is not so limited but is susceptible of many changes and variations. Thus, the invention may be expressed in terms of the following claim language or equivalents thereof.

I claim:

1. A latch having electric dogging means controlling the operating means and comprising:

(a) a housing;

(b) an operating spindle hub journaled in the housing and having a dog-engaging surface thereon;

(c) a latch means in the housing;

(d) means operatively connecting the hub and the latch means; and (e) electric dogging means comprising:

1. an electric solenoid having a rotary output plate mounting at a point spaced from its center of rotation a drive pin, the plate rotating from a first position to a second position upon activation of the solenoid;
2. a dogging slide including a flat portion disposed against the output plate but having a transverse elongate slot receiving the drive pin and a dogging blade portion adapted to engage the dogging surface in either first or second position of the plate;
3. spring means associated with the solenoid and biasing the plate toward the first position, the mounting of the solenoid and spring permitting 180° reversible disposition so that depending on that disposition, the pin is disposed respectively in opposite ends of the slot thereby either dogging the hub in solenoid activated or in solenoid deactivated condition.

2. A latch as claimed in claim 1 wherein the spring is generally C-shaped and has one end engaging its drive pin and the other end secured to the housing.

3. A latch as claimed in claim 2 wherein the said other end is clamped between the solenoid and the housing.

4. A latch as claimed in claim 1 wherein said dog-engaging surface comprises a recess disposed radially of the hub.

5. A latch as claimed in claim 1 wherein the elongate slot is in a straight line.

* * * * *